United States Patent [19]

Seiler et al.

[11] 4,358,257

[45] Nov. 9, 1982

[54] PISTON PUMP INSTALLATION AND METHOD OF OPERATING THE SAME

[75] Inventors: Niklaus Seiler; Hanspeter Seiler, both of Erlinsbach, both of Switzerland

[73] Assignee: Maschinenfabrik Meyer AG, Deitingen, Switzerland

[21] Appl. No.: 873,699

[22] Filed: Jan. 30, 1978

[30] Foreign Application Priority Data

Feb. 4, 1977 [CH] Switzerland ..... 1421/77

[51] Int. Cl.[3] ..... F04B 15/02; F04B 7/02

[52] U.S. Cl. ..... 417/517; 417/519; 417/900

[58] Field of Search ..... 417/517, 518, 519, 900

[56] References Cited

U.S. PATENT DOCUMENTS

| | | | |
|---|---|---|---|
| 3,682,575 | 8/1972 | Guddal et al. | 417/517 |
| 3,704,080 | 11/1972 | Cross | 417/518 |
| 4,105,373 | 8/1978 | Calzolari | 417/317 |

FOREIGN PATENT DOCUMENTS

| | | | |
|---|---|---|---|
| 31915 | 10/1932 | Netherlands | 417/519 |
| 651482 | 4/1951 | United Kingdom | 417/519 |

*Primary Examiner*—Richard E. Gluck
*Attorney, Agent, or Firm*—Werner W. Kleeman

[57] ABSTRACT

A piston pump installation, and method of operation the same, for conveying sludge-type materials and granulated and solid materials with added fluid, comprising one or more, preferably two, cylinders arranged adjacent and parallel to one another with axially reciprocating pistons therein. Each cylinder having a valve provided at its front end, and a drive and control device located at the rear, opposite end. The valve located at the front of each cylinder is structured as a slide valve or so that it can turn and is connected to a suction main on one side and to a delivery pipe on the other side, the suction main and the delivery pipe preferably being perpendicular to the longitudinal axis of the cylinder. Each valve having a valve body with an inlet orifice and a cutting edge as well as an overlapping surface. The inlet orifice in the valve body being designed as a flow connection between the suction main and the cylinder as well as between the cylinder and the delivery pipe. At the rear end of the cylinders together with the drive and control device, a pressurized buffer vessel for a barrier medium is provided for balancing the pressure of the pump piston.

12 Claims, 6 Drawing Figures

PISTON PUMP INSTALLATION AND METHOD OF OPERATING THE SAME

BACKGROUND OF THE INVENTION

The present invention relates to a new and improved construction of piston pump installation for conveying sludge-type materials and granulated and solid materials with added fluid, composed of one or more, preferably two, cylinders arranged adjacent and parallel to one another with axially reciprocating pistons therein, a respective valve provided at the front end of each cylinder, and a drive and control device located at the rear, opposite end, and further relates to a method for operating the piston pump installation according to the invention.

For conveying waste materials, pre-treated sewage sludge or other pasty materials, such as, for example, in sewage treatment plants and in the paper and sugar industry, piston pumps have been increasingly used in recent times, in addition to the generally customary conveying devices, such as chain conveyors or conveyor belts, by means of which these materials are conveyed.

In the case of these known piston pumps, fluid is added to the material to be conveyed so that a sludge-type mass is formed. The piston generates a reduced pressure in the pump cylinder and, after opening a valve, the material is sucked into the cylinder. By moving the piston in the opposite direction, the material is pressed under high pressure through an ejector valve into the pipelines.

This known arrangement has the disadvantage that only intermittent charging is possible so that the pipelines are also exposed to a non-uniform pressure load or stress and leakages and defects can occur therein.

SUMMARY OF THE INVENTION

It is an object of the present invention to provide a piston pump installation in which the material can be conveyed without shocks and continuously, without pressure shocks occurring in the pipelines or deflagrations being caused in combustion installations and/or gasification installations by shock-wise charging.

Another significant object of the present invention aims at providing a new and improved method for operating a piston pump installation in a manner such that it is possible to continuously convey free of shocks or surges the material intended to be conveyed, and without pressure surges occurring in the pipelines, and without creating conditions, which otherwise might prevail due to undesirable shock-wise or surge-like charging, of equipment working with the piston pump installation, which might precipitate hazards, such as explosions in such equipment.

According to the invention there is provided a piston pump installation for conveying sludge-type materials and granulated and solid materials containing added fluid, comprising one or more, preferably two, cylinders arranged adjacent and parallel to one another with axially reciprocating pistons therein. A respective valve is provided at the front end of each cylinder, and a drive and control device is located at the rear, opposite end. Each valve located at the front of each cylinder is designed as a slide valve or so that it can turn and is connected to a suction main on one side and to a delivery pipe on the other side. The suction main and the delivery pipe preferably are arranged perpendicular to the longitudinal axis of the cylinder. Each valve has a valve body with an inlet orifice and a cutting edge as well as an overlapping surface. The inlet orifice in the valve body is designed as a flow connection between the suction main and the cylinder as well as between the cylinder and the delivery pipe. At the rear end of the cylinders together with the drive and control device, there is provided a pressurised buffer vessel for a barrier medium for balancing the pressure of the pump pistons.

It is also advantageous when the overlapping surface of each valve is designed to close off the suction main and the delivery pipe from one another during the turning movement of the valve and the valve body has a flow-promoting channel directed towards and away from the cylinder.

A particular advantage of the constructions according to the invention is that the arrangement of a valve, designed as a slide valve or so that it can turn, at the pressure end of the cylinders (on the left in the drawing), the sliding or turning part of the valve, as the case may be, being alternately connected to the suction main and to the delivery pipe, makes continuous, shock-free conveying possible, in particular in the case of piston pumps with twin cylinders. This is so because the opening and closing movement of the valve can be controlled in such a way that the material to be conveyed is always ejected from one cylinder into the delivery pipe, without interruption. During the opening movement of the valve body, the cutting edge located on the valve body smoothly severs the material passing from the cylinder into the delivery pipe so that no squeezed-off material adheres to the cylinder walls during the next suction stroke.

As a result of providing an overlapping surface on the valve body, the suction side or the suction main is in every case closed off from the pressure side/delivery pipe during the opening or closing movement, the overlap being designed so that even part of the suction main can never be open to the delivery pipe. The ratio of the diameter of the orifice in the valve body to the inlet and outlet orifice is adjusted so that a mutual opening of both channels cannot occur in any case.

The advantageous design of a flow-promoting channel in the valve body, coinciding with the direction of inflow and outflow of the material to be conveyed, prevents residues from remaining in the valve so that its movements cannot be impeded.

The arrangement of the drive and control device at the rear end of the cylinder, together with a pressurised buffer vessel for a barrier medium, results in short control lines and pressure lines for the piston drive as well as in simple relief of the piston seals for directing barrier medium behind the pistons, since the barrier medium acts on the rear of the pistons as a pressure balance.

According to a further advantageous development of the subject of the invention, the suction main can be arranged at an angle between 10° and 135° with respect to the longitudinal axis of the cylinder.

This arrangement will be advantageous wherever a vertical arrangement is not possible for reasons of space and an adverse effect on the flow of material, relative to the flow-promoting channel in the valve body, must not occur.

Furthermore, it is particularly advantageous to design the cutting edge of each type of valve in the shape of a sickle which ensures that the material ejected from the cylinder is smoothly severed.

The piston pump installation according to the invention is operated in the following method steps:

(a) while the piston of the first cylinder is at the rear dead-center after material has been sucked in, the valve of this cylinder is closed at one end, i.e. the inlet end, so that the previous flow connection between the suction main and the cylinder is switched over to the flow connection from cylinder to delivery pipe;

(b) simultaneously, the piston of the second cylinder is moved in the direction of the valve, specifically so far that, when the valve of the first cylinder is switched over, the front dead-center has not yet been reached, but the piston continues to move at the same speed and ejects, over the entire stroke, the material present in the cylinder through the valve which is still in flow connection from cylinder to delivery pipe;

(c) when the front dead-center of the piston of the second cylinder is reached, the piston of the first cylinder starts the ejection stroke for the material present in the cylinder, the valve remaining open;

(d) the valve is opened in the direction of flow from suction main to cylinder and, after the valve has opened completely, the piston in the second cylinder is moved to the rear dead-center and material is thus sucked in through the suction main; and (e) during each turning movement of the valves of both cylinders, the material emerging from one of the cylinders is severed by the cutting edges of the valves during their closing movement.

The control and the drive of the installation according to the invention are preferably effected by means of a conventional high-pressure hydraulic unit which is in itself known.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
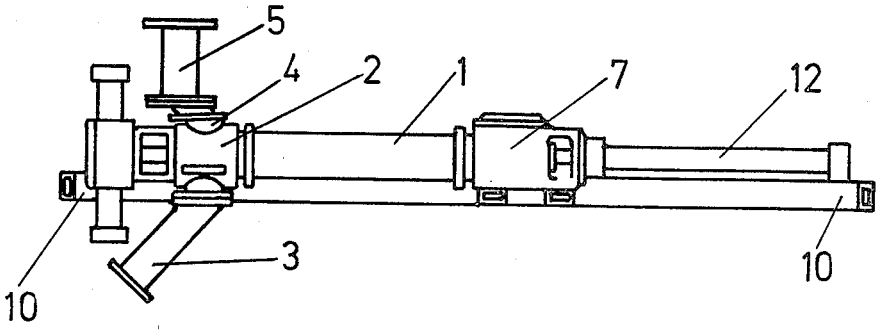
FIG. 1 shows a side view of the piston pump installation according to the present invention.
Figure 2:
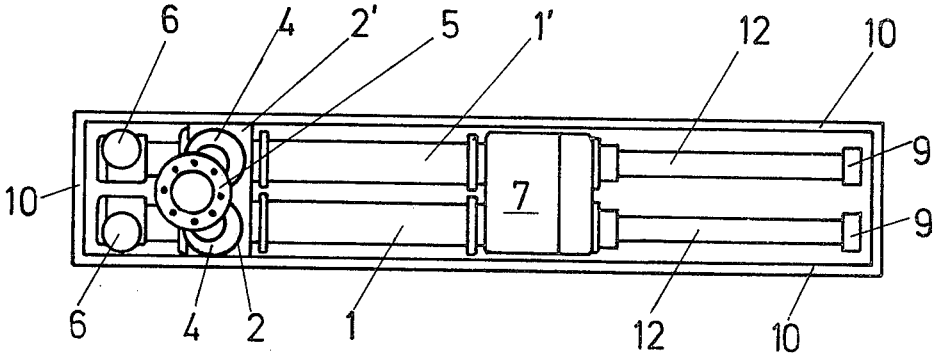
FIG. 2 shows a plan view of the installation according to FIG. 1.

According to FIGS. 1 and 2, reference numeral 1 designates a cylinder of a piston pump, preferably a twin-pipe piston pump, in which valves 2, preferably rotating type valves, are located at the front cylinder end, that is to say on the left in the drawing. The valves 2 are preferably designed as rotating or turning valves but may also conveniently be designed as slide-type valves, and each open, on one side, into a suction main or conduit 3 and, on the other side, into a delivery pipe 4, it being possible for the two delivery pipes 4 to lead into an outlet manifold or collecting pipe 5. Adjacent to the valves 2, a valve drive and control device 6 for each valve 2 is provided which is connected to a hydraulic unit (not shown). At the opposite rear end of the cylinder 1 a pressurised buffer vessel 7 is located for supplying the cylinder space behind the pistons 13 (FIG. 3) with barrier medium 11. The pressurised buffer vessel 7 surrounds piston rods 8 (FIG. 3), at the outer ends of which a drive device 9 which is likewise connected to the hydraulic unit is provided, the piston rods 8 being enclosed in a guide tube 12 between the pressurised buffer vessel 7 and the drive device 9. The complete piston pump installation is mounted on a frame 10.

Figure 3:
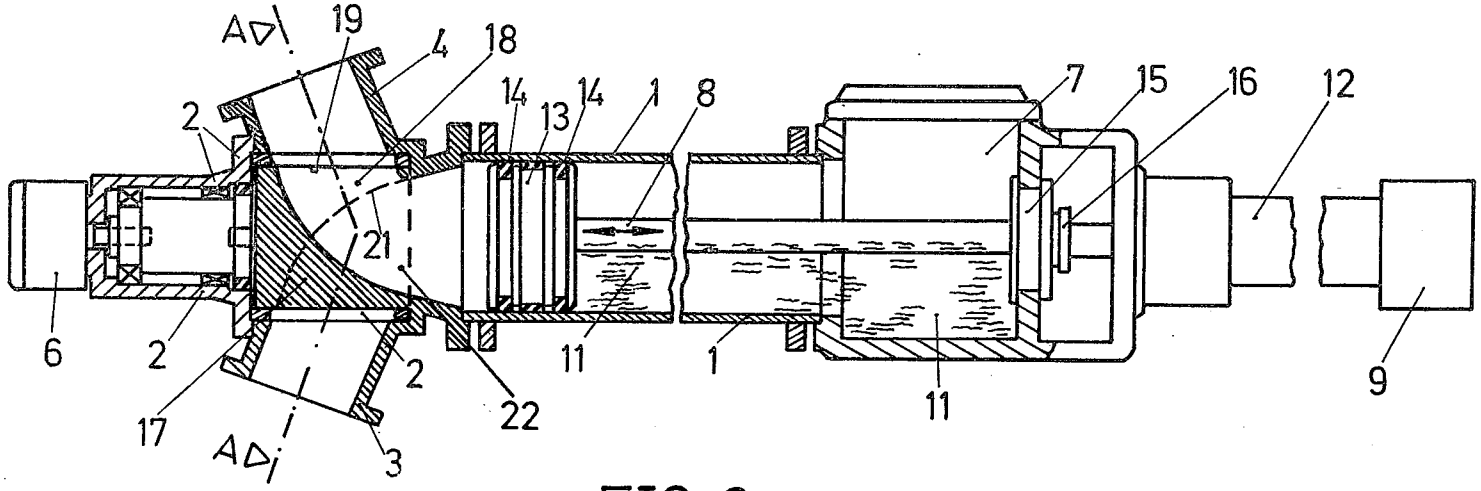
FIG. 3 shows a longitudinal section through the installation according to FIG. 1, preferably equipped with a rotating valve.

In the representation in longitudinal section in FIG. 3, reference numeral 1 again designates the cylinder in which the piston 13 with seal rings 14 distributed over the outer periphery is set in reciprocating motion, in the direction of the double-headed arrow, by the piston rods 8 driven via the drive device 9. A guide bushing 15 with a seal is located at the rear end of the pressurised buffer vessel 7 where the piston rod 8 passes through, and a stop 16 for limiting the advance of the piston or the stroke of the piston is located on the piston rod 8.

The front end, on the left in the drawing, of the cylinder 1 is closed off by the valve 2 which in this case is a rotating-type valve in which a valve body 17 is provided which can turn and which is driven and controlled by the valve drive and control device 6. A slide valve could also be used in place of the rotating valve. The suction main 3 and the delivery pipe 4 are fixed to the valve 2 in such a way that the particular direction of flow coincides with the flow-promoting channel 18 formed in the rotatable valve body 17. The suction main 3 and the delivery pipe 4 are arranged on the valve 2 in accordance with the assembly conditions, that is to say, they can be fixed at an angle of 90° to the longitudinal axis of the cylinder or/and between about 10° and 135° to the longitudinal axis of the cylinder. In addition, the valve body 17 which can rotate has a cutting edge 19 which preferably is designed in the shape of a sickle, and also has an overlapping surface 20 which makes it impossible for the channel 18, during the switch-over of the valve body 17 into a position according to the dashed line 21, to simultaneously keep the suction main 3 and the delivery pipe 4 wholly or partially open towards one another.

Figure 4:
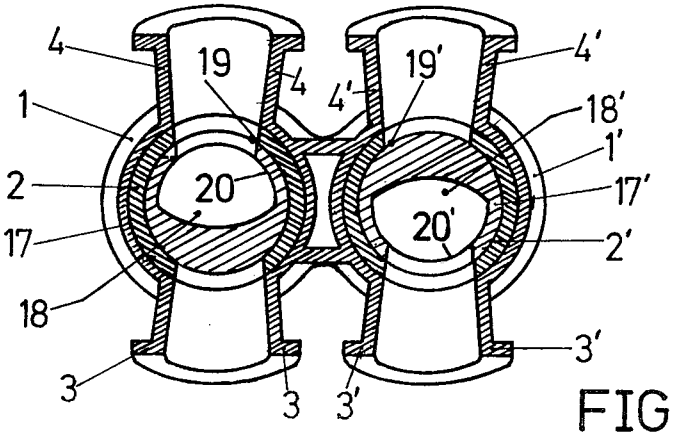
FIG. 4 shows a cross-section through the valves of an installation consisting of two cylinders, along the section line A—A of FIG. 3.

The two valves 2, 2', shown in FIG. 4 along the section line A—A in FIG. 3, of a twin-cylinder piston pump installation are in different positions of the rotatable valve bodies 17, 17'. Thus, in the left-hand valve 2, the channel 18 is open to the suction main 3, whilst in the right-hand valve 2', the channel 18' is open to the delivery pipe 4'. It can be seen from the positions, drawn in dashed lines, of the valve bodies 17, 17' in the two halves 2, 2' that, when both valves 2, 2' are switched over, both overlapping surfaces 20, 20' are sufficiently large to preclude even a partial simultaneous freeing of the orifices of each channel 18, 18' to the suction main 3 or 3' and to each delivery pipe 4, 4' of the valves 2, 2' respectively.

Figure 5B:
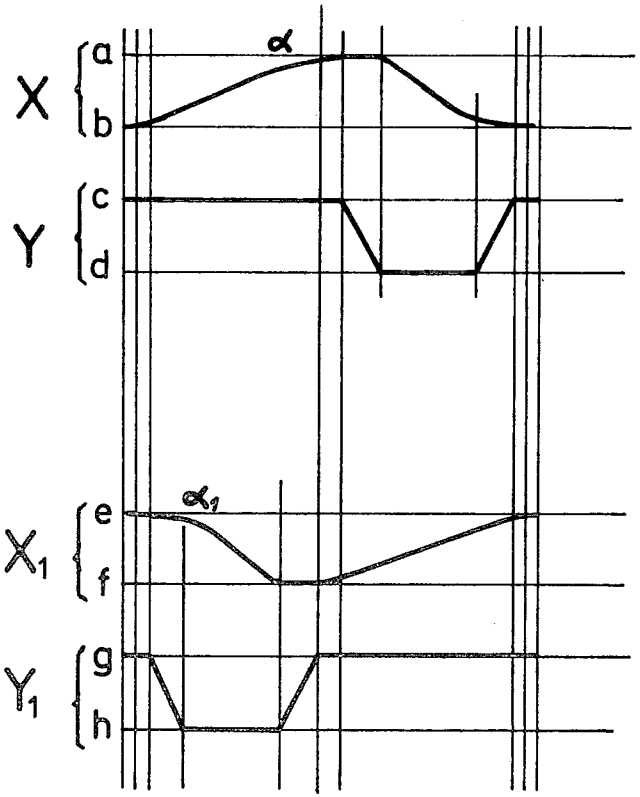
FIGS. 5*a* and 5*b* show movement diagrams of the pistons and valves of a twin-cylinder piston pump installation, these being the same in the case of both a slide-type or rotating type valve.
Figure 5A:
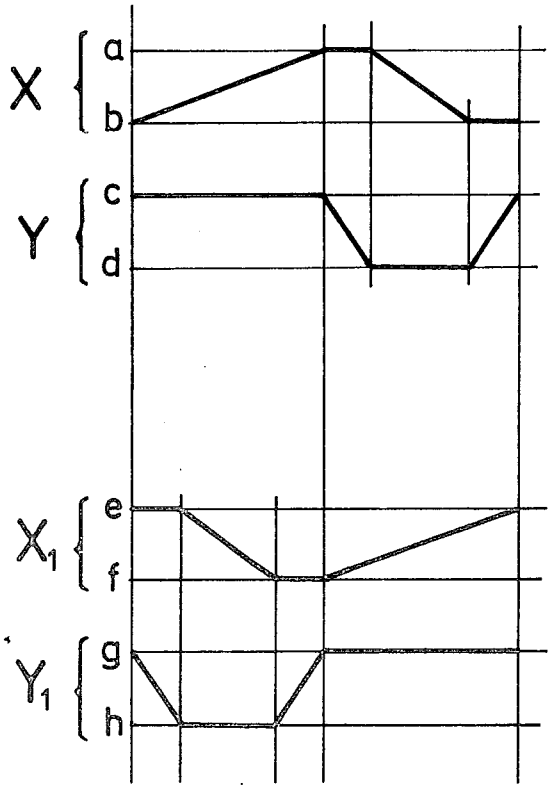

An explanation of the continuous, that is to say infinitely controllable, mode of operation of the subject of the invention may be seen from the movement diagram in FIG. 5*a* in which the course of movement of the pistons and valves is plotted on the vertical lines or ordinates and the horizontal lines or abscissas delimit the periods of the strokes and of turning the valves.

Here, the first two lines from the top represent the front (a) and rear (b) dead-center of the piston in the first cylinder (X), whilst the third and fourth lines (c, d) show the pressure and suction positions respectively of the first valve Y. The lines e, f, g and h, shown underneath, relate to the piston of the second cylinder $X_1$ and, respectively, to the corresponding positions of the valves $Y_1$ of the second cylinder.

After material has been sucked in, the piston 13 of the first cylinder X moves from the rear dead-center b to the front dead-center, the valve Y opens towards delivery pipe 4 and the material is ejected through the channel 18. The valve 2 now switches over, that is to say, the valve body 17 is turned so that the channel 18 is in flow connection to the suction main 3. At the same time, the piston 13 of the second cylinder $X_1$ moves in the direction of the front dead-center, but only up to a distance shortly before reaching the latter so that, when the valve Y of the first cylinder is switched over, there still remains a short length of stroke to be covered, the speed of the piston remaining constant. The material present in the cylinder in front of the piston is ejected through the valve $Y_1$ which is in the position pointing in the flow direction from the cylinder to the delivery pipe 4'. As soon as the piston of the second cylinder $X_1$ has reached the front dead-center, the piston of the first cylinder X starts moving in the direction of the front dead-center and hence ejecting the material present in the cylinder X through the valve Y which is open to the delivery pipe 4. The valve $Y_1$ is turned into flow connection to the suction main 3' and, when the end position of the turning movement is reached, the piston of the second cylinder $X_1$ moves to the rear dead-center and sucks material into the cylinder $X_1$ through the suction main 3'. This process is continuously repeated.

During each turning or rotating movement of the valve bodies 17, 17' (of the valves 2, 2' designated in the diagrams as Y and $Y_1$), the material emerging from the cylinders is severed by the cutting edges 19, designed in the shape of a sickle, of the valve bodies.

The movement diagram reproduced in FIG. **5*b* shows the same course of movement as in FIG. 5*a*, but with the difference that the two pistons in the cylinders X and $X_1$ have a reduced final or initial speed before reaching the front dead-center and after leaving the rear dead-center respectively, and this can be seen from the curved lines at the points $\alpha$ and $\alpha_1$. In this way, a completely shock-free ejection of the material is achieved, and overloading of the outlet manifold 5** is prevented to the largest possible extent.

The pressurised buffer vessel 7, in which a pressure fluid is held under a pressure which is in a predetermined ratio to the working pressure of the piston pump, makes it possible to build-up a pressure in the cylinder space behind the piston 13 so that, if there is a defect in the valves 2, 2' or in the delivery pipes 4, 4' or the outlet manifold, the pistons 13 are prevented from being flung under the full working pressure in the direction of the read dead-center, which could lead to fracture of the piston rods 8 or the cylinders 1, 1'. It is possible without a large constructional expense to control the pressure in the pressurised buffer vessel 7 together with the drive device 9 in such a way that a variable pressure gradient is produced alternately in the individual cylinder spaces behind the pistons 13.

While there are shown and described present preferred embodiments of the invention, it is to be distinctly understood that the invention is not limited thereto, but may be otherwise variously embodied and practiced within the scope of the following claims. Accordingly,

What we claim is:

1. A piston pump installation for conveying materials, especially sludge-type materials and granulated and solid materials with added fluid, comprising:

a piston cylinder unit;

said piston and cylinder unit comprising at least one cylinder;

a piston arranged for axial reciprocating movement in said cylinder;

said cylinder having a front end and a rear end;

a valve provided at the front end of said cylinder for controlling feed of the conveyed material out of the front end of said cylinder;

a drive and control device for the piston and cylinder unit located at the rear end of the cylinder;

a suction main and a delivery pipe located to opposite sides of said valve;

said valve at the front end of said cylinder being structured as a movable valve unit operatively associated at one side thereof with said suction main and at the other side thereof with said delivery pipe;

said movable valve unit including a valve body with an inlet orifice and a cutting edge as well as an overlapping surface;

the inlet orifice of the valve body constituting a flow connection between the suction main and the cylinder as well as between the cylinder and the delivery pipe; and a pressurized buffer vessel safety means at the rear of said cylinder for providing a barrier medium which is in continuous contact with said piston for balancing the pressure of the piston and cylinder unit.

2. The piston pump installation as defined in claim 1, wherein:

said movable valve unit comprises a slideable rotary valve.

3. The piston pump installation as defined in claim 1, wherein:

the suction main and the delivery pipe are disposed at an angle of between 10° and 135° to the longitudinal axis of the cylinder.

4. The piston pump installation as defined in claim 1, further including:

an additional piston and cylinder unit;

said additional piston and cylinder unit comprising a cylinder and a piston axially reciprocating therein;

the cylinder of said additional piston and cylinder unit having a front end and a rear end;

a valve located at the front end of the cylinder of said additional piston and cylinder unit;

said cylinder of said additional piston and cylinder unit being provided with a suction main on one side of said valve and a delivery pipe on the other side of said valve;

said valve of said cylinder of said additional piston and cylinder unit comprising a movable valve unit having a valve body with an inlet orifice and a cutting edge as well as an overlapping surface;

the inlet orifice in the valve body of the valve of the cylinder of the additional piston and cylinder unit constituting a flow connection between its suction main and its cylinder as well as between its cylinder and its delivery pipe;

the rear end of both cylinders being provided with said pressurised buffer vessel for a barrier medium for balancing the pressure of the pump pistons.

5. The piston pump installation as defined in claim 4, wherein:

a common pressurised buffer vessel for a barrier medium is provided for both of the piston and cylinder units.

6. The piston pump installation as defined in claim 4, further including:

an additional drive and control device located at the rear end of the cylinder unit of the additional piston and cylinder unit.

7. The piston pump installation as defined in claim 4, wherein:

the suction main and the delivery pipe of the cylinder of the additional piston and cylinder unit are disposed at an angle of between 10° and 135° to the longitudinal axis of such cylinder.

8. The piston pump installation as defined in claim 4, wherein:

the overlapping surface of each valve is structured to close off the related suction main and delivery pipe from one another during the opening and closing movement of such valve.

9. The piston pump installation as defined in claim 5, wherein:

the movable valve unit of the cylinder of the additional piston and cylinder unit comprises a slideable rotary valve.

10. The piston pump installation as defined in claim 1, wherein:

the flow connection of the valve body provides a flow-promoting channel having end portions directed towards and away from the cylinder.

11. The piston pump installation as defined in claim 1, wherein:

said suction main is arranged at an angle in a range of between about 10° and 135° with respect to the longitudinal axis of the cylinder.

12. The piston pump installation as defined in claim 1, wherein:

the cutting edge of said valve is structured to possess essentially the shape of a sickle.

* * * * *